United States Patent [19]

Rau et al.

[11] Patent Number: 4,926,668

[45] Date of Patent: May 22, 1990

[54] AUTOMATIC DIE BOX POSITIONING FOR DRAWBLOCK

[75] Inventors: Robert J. Rau, Pittsburgh; Donald H. Haydo, Ellwood City, both of Pa.

[73] Assignee: Italimpianti of America Incorporated, Coraopolis, Pa.

[21] Appl. No.: 408,671

[22] Filed: Sep. 18, 1989

[51] Int. Cl.[5] ..... B21C 1/02

[52] U.S. Cl. ..... 72/289

[58] Field of Search ..... 72/285, 289, 280, 278, 72/274

[56] References Cited

U.S. PATENT DOCUMENTS 2,107,799 2/1938 Pierson et al. ..... 72/278

2,748,924 6/1956 McIlvried ..... 72/285

FOREIGN PATENT DOCUMENTS 2445945 4/1976 Fed. Rep. of Germany ..... 72/285

810695 3/1959 United Kingdom ..... 72/285

*Primary Examiner*—Daniel C. Crane

*Attorney, Agent, or Firm*—Webb, Burden, Ziesenheim & Webb

[57] ABSTRACT

Clamping system for the die box of a continuous drawblock apparatus providing an infinitely adjustable position about a first axis after the drawbox has naturally rotated to the correct drawing position whereby the tubing exits from the die in a direction tangent to the capstan where the tubing first contacts the capstan.

5 Claims, 4 Drawing Sheets

AUTOMATIC DIE BOX POSITIONING FOR DRAWBLOCK

FIELD OF THE INVENTION

This invention relates to equipment for the high speed production of long length, small diameter, thin wall tubing and the like. Known in the industry as drawblocks, this equipment is used for the processing of copper, aluminum, brass and ferrous tubing. More particularly, this invention relates to continuous drawblocks.

BACKGROUND OF THE INVENTION

Tubing is produced at the desired diameter by drawing larger diameter tubing through a die having a tapered orifice therein with a floating die plug positioned within the larger diameter tubing as it enters the tapered orifice. The process is repeated with dies having smaller orifices and smaller die plugs until the desired outer diameter is achieved. With each pass through a die, the diameter and wall thickness of the tubing is reduced and the length of the tubing is increased.

The tubing both before and after being drawn through the die is formed into coils, say, up to 125 inches in diameter, depending upon the particular materials and equipment. The coiled tubing is passed to the die from a rotating pay-off reel or pay-off tray. The tubing is pulled through the die by being wrapped upon a rotating drawblock. The axes of rotation of the pay-off tray and the drawblock may be vertical or horizontal. This invention relates, for the most part, to vertical drawblocks, i.e., having vertical axes of rotation. The tubing forms a coil as it is wrapped upon the drawblock. The tubing cannot be overlapped upon the drawblock for the obvious reason that it would be crushed out of shape. Two types of drawblocks are used: One, known as non-continuous, has a long axial length winding drum. The die box is shifted in the axial direction relative to the drum as the tubing is wrapped upon it to prevent overlap. The length of the tubing wrapped upon the drawblock is limited by the length and diameter of the winding drum. Another, type of drawblock, known as continuous, is arranged so that as the tubing is wrapped upon the drum of the drawblock (in this case a capstan), the wraps are urged down to one end where they fall off the capstan. After the initial wraps are established upon the drum, the die remains in a fixed axial position relative to the capstan. Each new wrap is laid upon the same position on the capstan and is immediately moved (plowed) away to make room for the next wrap. For every wrap added to the drawblock, another falls off the capstan into a receiving tray. In the case of a continuous drawblock, the rotating speeds of the pay-off tray and the receiving tray are synchronized with the capstan to suit the coil diameters at each of these stations.

The diameter of the drawblock is related to the entry and finished size of the tubing. For example, for a three inch entry tubing diameter finishing down to ¼ inch, the diameter of the drawblock may be about 84 inches and for smaller entry tubing diameter finishing down to ⅛ inch, the diameter of the drawblock may be 60 inches or 40 inches. Typically, tubing is pulled through the die and wrapped upon the drawblock at speeds up to 4000 feet per minute.

Prior to drawing a tube through the die, the operator first deposits lubricant, then inserts the die plug in the tube near the end to be fed to the die. As a practical matter, the operator dimples the tubing to restrict the position of the plug a desired distance from the end of the tube. The operator then "points" (tapers) the end of the tube in a machine designed especially for that purpose. He can then start the pointed end of the tube through the die. A gripper fixed to the capstan is used to secure the end of the tube passed through the die so that the tube will be pulled through the die as the capstan is rotated. The operator then initiates rotation of the capstan. In the continuous drawblock, the tubing is automatically cut free from the gripper after a number of wraps, say 5 to 10, have been placed upon the capstan. Thereafter, as each new wrap is added to the capstan another falls away.

The die is carried by a die box which is a stage for holding the die and a plurality of guide wheels having grooved rims for guiding the entry tubing into the die. The spacing of the guide wheels is adjustable to accommodate entry tubing of various diameters. Likewise, the die is interchangeable in the die box to accommodate the size of the entry tubing.

The die box is mounted to provide at least three modes of freedom. The die box must be translated in the direction of the axis of the capstan from a position opposite the gripper to the position where the wraps are continuously laid upon the capstan. This is usually a vertical translation of, say, 24 inches. The die box is also journaled to rotate about an axis parallel to the axis of the capstan (usually a vertical axis). It rotates from an angular position where tubing exiting from the die is aligned with the position of the gripper to an angular position where the tubing exiting the die is aligned with the tangent to the capstan where the tubing first contacts the capstan. This rotation amounts to about 5 to 20 degrees. Still further, the die box is journaled to rotate about an axis (usually a horizontal axis) perpendicular to the already described axis to permit the tubing to face the axial position on the drawblock where tubing is being wrapped upon the capstan. Hence, the die box rotates from a horizontal position at the time of griping (the start of draw position) to point downwards as the die box is being translated upward to the drawing position where it rotates back to the horizontal position. This rotation amount to about 15 to 25 degrees.

Prior art die boxes were provided with hydraulic pistons and cylinders for clamping the die box to restrict rotation about the axis parallel to the axis of the capstan and in the direction of the gripper. Also, the die box could be clamped about this axis in the nominal direction of the tangent to the drum where the tubing first contacted the capstan. However, the direction was only correct for one diameter of tubing being wrapped upon the capstan and was incorrect for all other diameters. Tubes pulled through the die when the direction of the tube exiting from the die was incorrect could be improperly formed with variable wall thickness or, worse yet, broken. For this reason, this axis was usually not clamped in the drawing position. Unfortunately, this also has its drawbacks. The action of the entry tubing uncoiling from the pay-off tray and the tubing wrapping upon the capstan could set up vibrations of the die box that affect the uniformity and surface of the finished tubing. More serious, if the die box were bumped or an imperfection in the tubing passed through the die, the die box could be jolted enough to cause a break in the tubing.

SUMMARY OF THE INVENTION

It is an advantage, according to this invention, to provide a continuous drawback having a die box that naturally seeks the correct angular position about the axis parallel to the axis of the capstan and which can be clamped in this correction position to prevent vibrations or jolts about that axis.

Briefly, according to this invention, a continuous drawblock apparatus for drawing tubing through a reducing die comprises a capstan upon which the tubing is wrapped after passing through the die. The capstan has an associated gripper and shear for gripping and automatically releasing the end of the tubing held at an axial position relative to the capstan known as the "start of draw" position. The die is carried by a die box mounted for translation in the axial direction, for rotation about a first axis parallel to the axis of the capstan and for rotation about a second axis perpendicular to the first axis. It is an improvement, according to this invention, that apparatus is provided for clamping the die box in an infinitely adjustable position after it has naturally rotated to the correct drawing position whereby the tubing exits from the die in a direction tangent to the capstan where the tubing first contacts the capstan.

According to a preferred embodiment, the die box is hung from a hub journaled on a first axle which provides rotation about a first axis. A first radial flange extends from the hub and a second radial flange is fixed relative to the first axle. A hydraulic caliper brake mounted upon one flange clamps down upon the other flange to enable clamping of the die box in an infinite number of angular positions about the first axis.

BRIEF DESCRIPTION OF THE DRAWINGS

Further features and other objects and advantages will become apparent from the following detailed description made with reference to the drawing in which.

DESCRIPTION OF THE PREFERRED EMBODIMENTS

Figure 1:
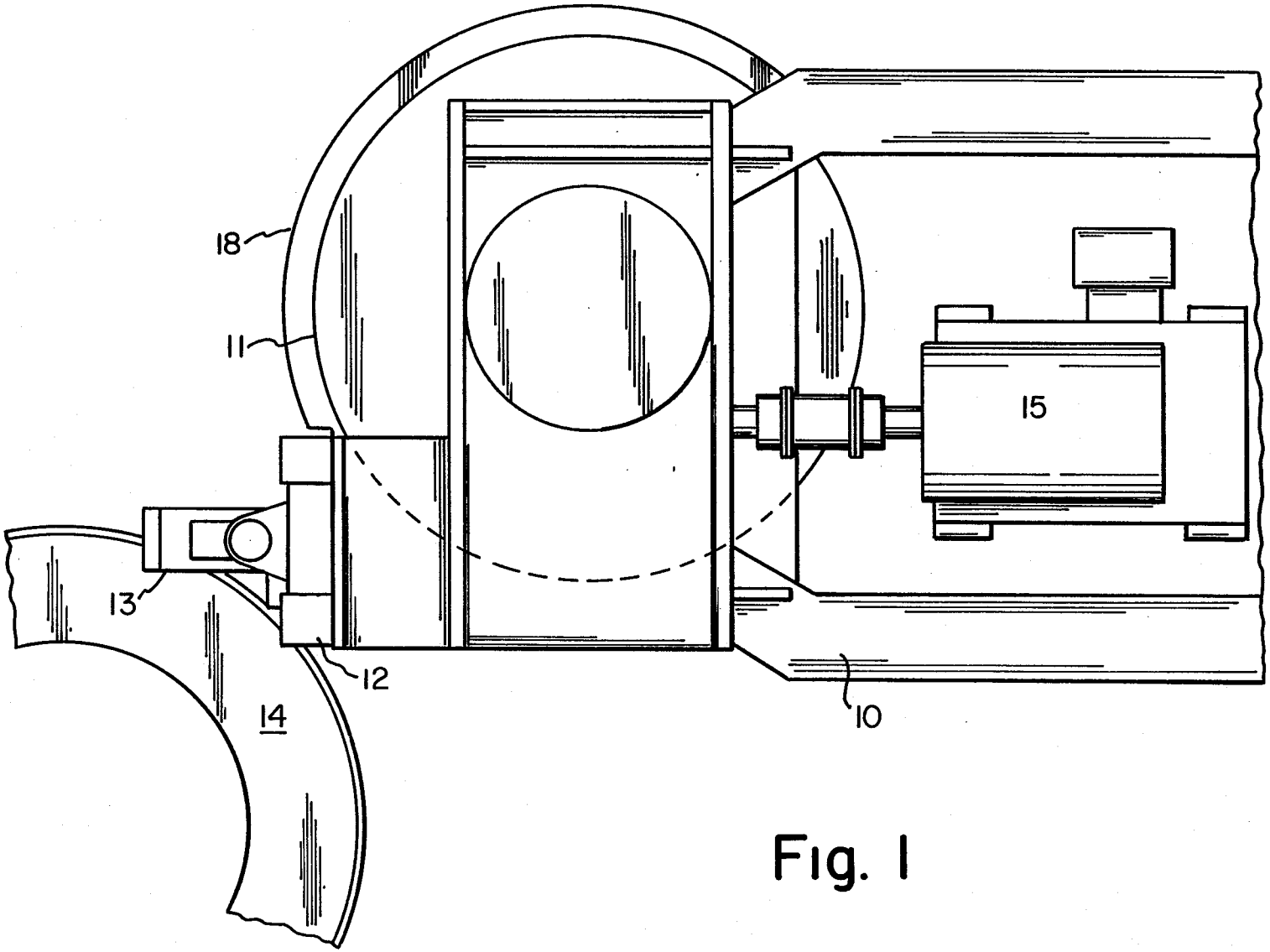
FIG. 1 is a plan view of a continuous drawblock illustrating the position of the pay-off tray during drawing.
Figure 2:
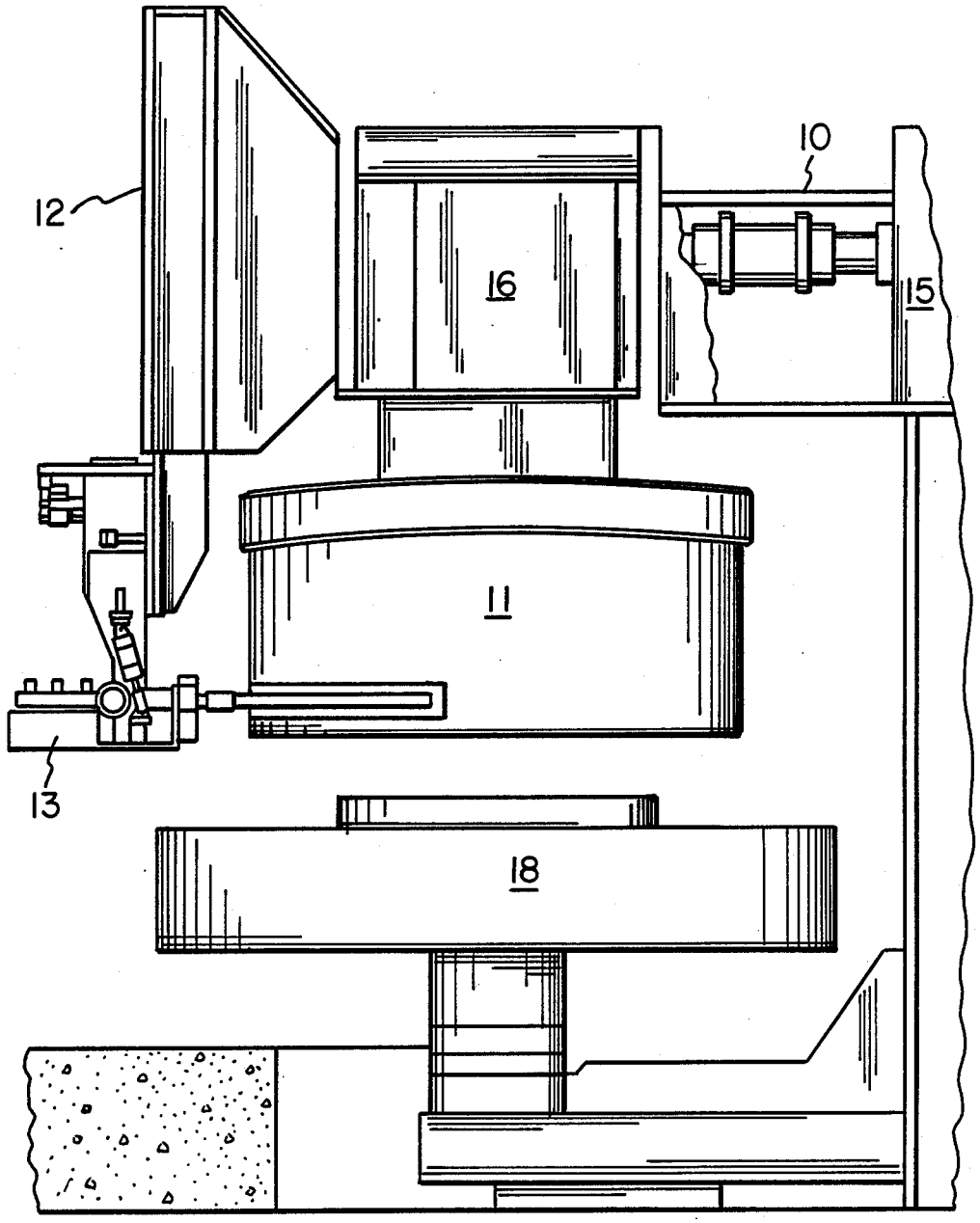
FIG. 2 is a side view of a continuous drawblock according to FIG. 1 showing the direction of the receiving tray.

Referring now to FIGS. 1 and 2, there is shown the superstructure 10 of a vertical continuous drawblock. The superstructure 10 supports the capstan 11 on a vertical axis and also the track 12 for guiding the die box 13 vertically up and down. The pay-off tray 14 is shown (see FIG. 1) in position for delivering tubing to the die box 13. The capstan is driven by motor 15 through bevel gears 16. When the draw is completed the empty pay-off tray is moved under the capstan and becomes the receiving tray 18 (see FIG. 2). As explained above, the pay-off tray, capstan and receiving tray are driven in synchronism during a draw. Snubber rolls (not shown) are mounted to be compressed against the tubing wrapped upon the capstan during the drawing.

Figure 3A:
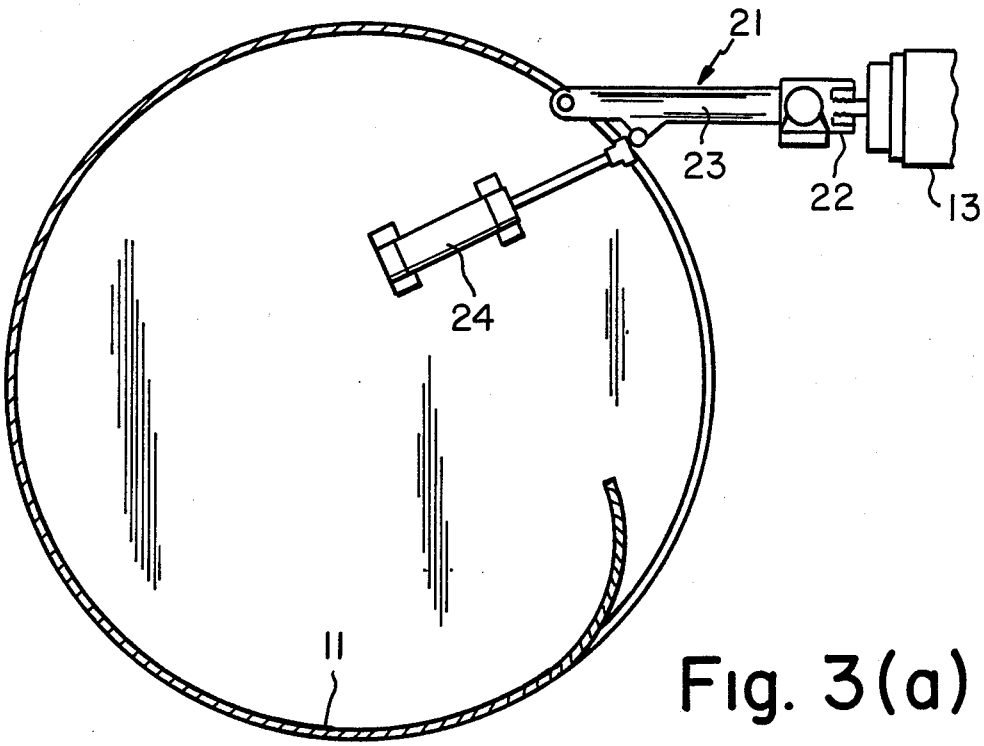
FIGS. 3(*a*), 3(*b*), and 3(*c*) are schematic section views taken through the capstan perpendicular to the axis of the capstan and show the gripper mechanism in relation to the capstan and die box at the time of gripping, at start up and during drawing, respectively.
Figure 3B:
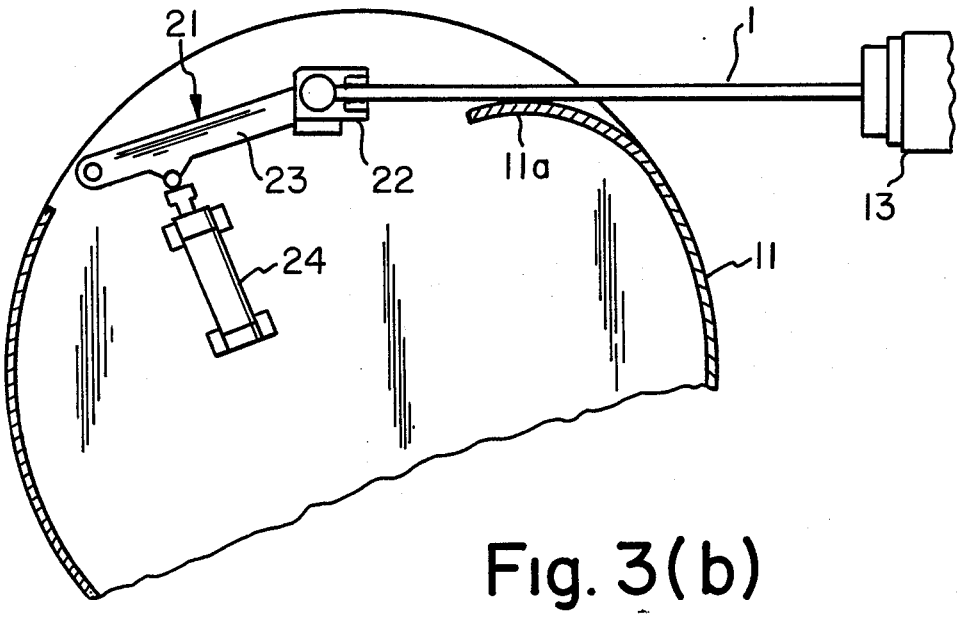
Figure 3C:
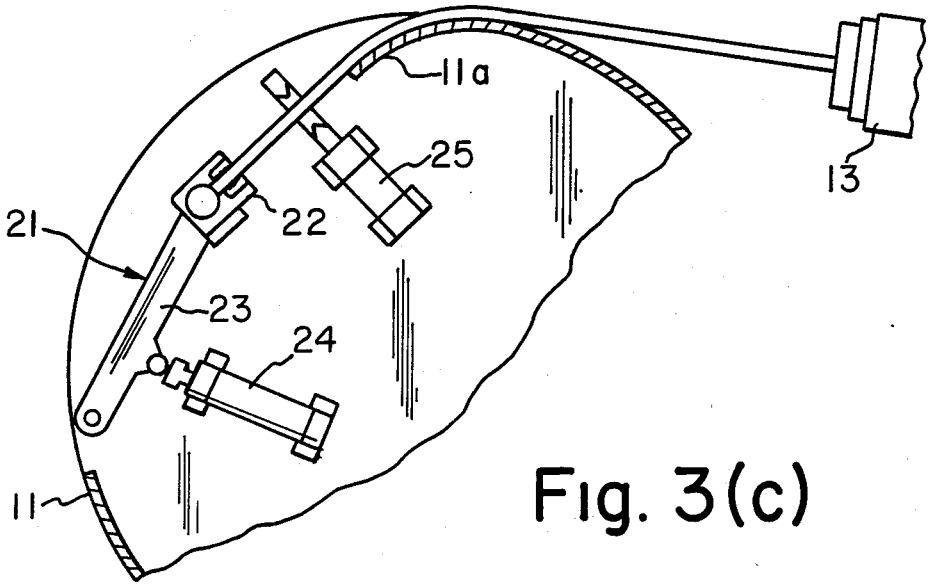

Referring now to FIGS. 3(*a*), 3(*b*) and 3(*c*), there is shown the gripper 21 mounted in the capstan 11 in the gripping position. The gripper has spring loaded jaws 22 with teeth that dig into the tubing 1 as the tubing is pulled away from the gripper. Tubing of various sizes can be forced into the jaws but cannot be withdrawn until the jaws are opened. The jaws 22 are at the end of an arm 23 that pivots on an axis parallel to the axis of the capstan and located inside of and near the rim of the capstan. The arm 23 swings (see FIG. 3 (*c*)) so that the arm 23 and the jaws 22 are completely within the rim during drawing so as not to interfere with the tubing 1 moving along the capstan and falling to the receiving tray. The arm 23 also wings out to a gripping position (see FIG. 3(*a*)) where the jaws 22 are adjacent to the die and the die box 13 with the jaws aligned with the tubing exiting from the die. Of course, the capstan must be at an indexed position for the gripper jaws to align with the die box when the gripper is swung out. The gripper is actuated by a hydraulic piston and cylinder 24 to hold it at either extreme position. After gripping and subsequent to the start of rotation the arm is swung inward with the rotation of the capstan so that the tubing is pulled straight away from the die box (see FIG. 3(*b*)). As rotation continues, the tubing wraps on a spiral shoe **11*a*** that forces the point of first contact of the tubing out to the rim of the capstan. With this movement, the die box must swing on its vertical axis so that the tubing continues to be drawn straight away from the die box. This movement is about 5 to 10 degrees in the embodiment illustrated in FIGS. 3(*a*), (*b*) and (*c*). Also, mounted within the capstan, is a shear mechanism 25 (see FIG. 3(*c*)) for severing the tubing to automatically release it from the gripper during drawing.

Figure 4:
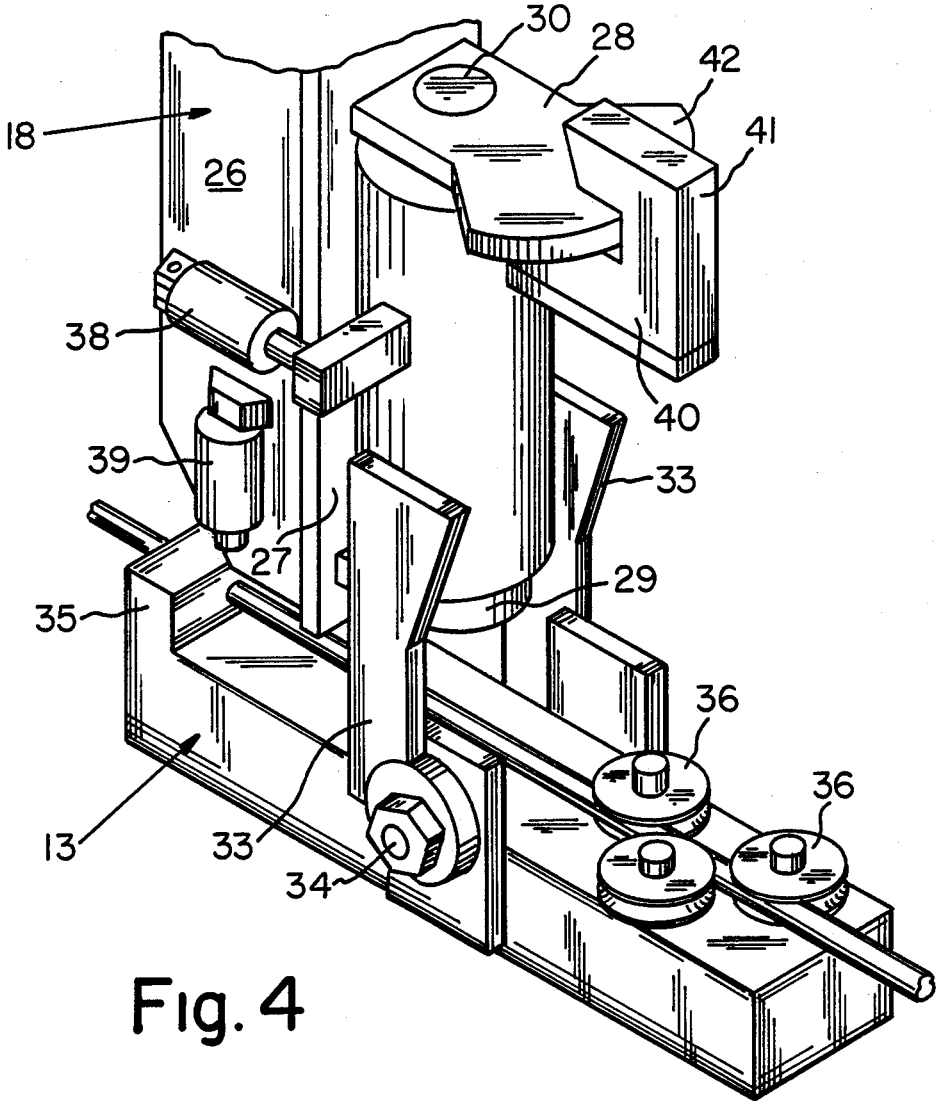
FIG. 4 is a schematic perspective of the die box shown in FIG. 3.

Referring now to FIG. 4, the die box 13 and die box mounting 18 are shown. Slide 26 moves within the track 12 (see FIG. 1) to raise and lower the die box. The relative movement of the slide and track are caused by a hydraulic piston and cylinder (not shown). Extending perpendicular from the face 27 of the slide 26 are two parallel plates 28, 29 that support an axle with its axis parallel to the axis of the capstan. Hub 31 is journaled to rotate about the axle 30. Brackets 33 extend down from opposite sides of the hub and support a rotating connection 34 to the die box which connection has an axis perpendicular to the axis of the axle 30 and hub 31. The die box carries the die 35 and guide wheels 36 that can be adjusted towards each other to guide tubing straight to the inlet of the die. Horizontal positioning pistons and cylinders 38 (on each side of the hub 31), when extended, lock the rotation of the die box about the first axle 30 in the gripping position aligning the die box with the extended gripper with the capstan in the indexed position. Vertical locking piston and cylinder 39, when extended, lock rotation about the axis defined by rotating connection 34 so that the die box is fixed perpendicular to the first axle (usually in the horizontal position).

Referring to FIG. 4, one of the plates 28 extends outwardly from the hub generally having a pie shape and a circular edge, the center of curvature of which is the axis of the first axle 30. Extending outwardly from the hub is a flange 40 that supports a hydraulically actuated caliper brake 41 for squeezing down on the pie-shaped plate extension 42. When the calipers are activated, the rotation of the die box about the first axle is prevented. The angular position of the die box about the first axle is infinitely adjustable within the range.

The sequence of operations of the continuous drawblock according to this invention is as follows. The drawing position of the die box is at the upper axial end of the capstan. At the end of a draw, the die box is returned downwardly to the lower axial end of the capstan known as the start of draw position as indicated on FIG. 2. The caliper brake 41 is released. The horizontal positioning cylinders then rotate the die box to the gripping position, that is, to the proper angle to align with the gripper that has been extended from the capstan at the indexed position (see FIG. 3*(a)*). At this time the vertical locking cylinders 39 maintain the die box in the horizontal position. The new tubing is then threaded through the die box and die 35 into the jaws 22 of the gripper. When drawing is initiated (stall torque is applied) and just before upward traverse of the die box, the horizontal positioning cylinders 38 and the vertical locking cylinder 39 are deenergized and their pistons withdrawn allowing movement of the die box about both axles. During approximately the first rotation of the capstan, the die box is moved to the drawing position wrapping a helical wrap of large pitch upon the capstan. Because the die box is free to move, the end nearest the capstan dips downwardly so that the tubing exiting the die extends straight away toward the position on the capstan where the helical wrap is being laid. When the die box reaches the drawing position near the top of the capstan, additional wraps of tubing are laid upon the capstan in the same location on the capstan. As each wrap is laid at the drawing position it is urged downwardly by a plow (not shown) to make room for the next wrap. Shortly after the die box has reached the drawing position, the vertical locking cylinder 39 and the caliper brake 41 are energized to prevent rotation of the die box about both axes. The snubber rolls are compressed against the coil wrapped on the capstan and the shear 25 is actuated to cut the tubing free from the gripper. Drawing continues with the reduced diameter tubing falling into the receiving tray 18 until the entire length of coil in the pay-off tray 14 has passed through the die 35.

It should be noted that the angle of the die box at the drawing position is naturally set by the pull of the coil exiting from the die. Hence, energizing the caliper brake after drawing has been commenced allows the die box to be locked in the proper angle for the particular diameter of tube being drawn. This natural drawing position is also affect by machining discrepancies in the die box, die and plug.

By locking the die box during drawing, vibrations and jolts are prevented. Moreover, a more concentric tube is produced because side pressures in the tube caused by improper angular position of the die and plug are eliminated.

Having thus described our invention in the detail and particularity required by the Patent Laws what is desired protected by Letters Patent is set forth in the following claims.

We claim:

1. In a continuous drawblock apparatus for drawing tubing through a reducing die comprising a capstan upon which the tubing is wrapped after passing through the die, said capstan rotating upon an axis and having associated means for gripping and automatically releasing the end of the tubing held at an axial position relative to the capstan known as the start of draw position, said die carried by a die box, means for mounting the die box for translation in the direction of the axis of the capstan, for rotation about a first axis parallel to the axis of the capstan and for rotation about a second axis perpendicular to the first axis, the improvement comprising energizable means for clamping the die box in an infinitely adjustable position about the first axis after the drawing of the tubing has begun and the die box has naturally rotated to the correct drawing position, said clamping taking place in a manner not to jolt the die box, whereby the tubing exits from the die in a direction tangent to the capstan where the tubing first contacts the capstan.

2. The improvement according to claim 1 wherein the means for clamping comprises a radial flange and a caliper brake upon which it may clamp.

3. The improvement according to claim 2 wherein the caliper brake is hydraulically actuated.

4. The improvement according to claim 1 wherein the die box is hung from a hub journaled on a first axle to provide the rotation about the first axis, a first radial flange extending from the hub and the second radial flange fixed relative to the first axle, and caliper means mounted upon one radial flange for clamping upon the other.

5. The improvement according to claim 4 wherein the caliper means is hydraulically actuated.

* * * * *

UNITED STATES PATENT AND TRADEMARK OFFICE

CERTIFICATE OF CORRECTION

PATENT NO. : 4,926,668

DATED : May 22, 1990

INVENTOR(S) : Robert J. Rau and Donald H. Haydo

It is certified that error appears in the above-identified patent and that said Letters Patent is hereby corrected as shown below:

Column 2 Line 46 "amount" should read --amounts--.

Column 3 Line 7 "correction" should read --correct--.

Column 3 Line 45 "direction" should read --position--.

Column 4 Line 16 "wings" should read --swings--.

Column 6 Line 2 "affect" should read --affected--.

Signed and Sealed this

Third Day of September, 1991

*Attest:*

*Attesting Officer*

HARRY F. MANBECK, JR.

*Commissioner of Patents and Trademarks*